United States Patent [19]

Sterner, Jr.

[11] Patent Number: 4,935,987

[45] Date of Patent: Jun. 26, 1990

[54] SELF-CONTAINED HEAVY DUTY CONSTANT FORCE SLIDING SASH COUNTERBALANCE ASSEMBLY

[75] Inventor: Maurice E. Sterner, Jr., Spring Grove, Pa.

[73] Assignee: Product Design & Development, Inc., York, Pa.

[21] Appl. No.: 360,298

[22] Filed: Jun. 2, 1989

[51] Int. Cl.[5] ..... E05F 1/16

[52] U.S. Cl. ..... 16/198; 16/197; 16/DIG. 16; 16/DIG. 31; 49/445; 49/446

[58] Field of Search ..... 16/193, 196–198, 16/DIG. 16, DIG. 31; 49/445, 446

[56] References Cited

U.S. PATENT DOCUMENTS

| | | | |
|---|---|---|---|
| 2,609,193 | 9/1952 | Foster . | |
| 2,635,282 | 4/1953 | Trammell | 16/197 |
| 3,358,403 | 12/1967 | Dinsmore . | |
| 3,452,480 | 7/1969 | Foster | 16/197 |
| 3,457,865 | 11/1969 | Arnes . | |
| 3,992,751 | 11/1976 | Foster et al. | 16/197 |

*Primary Examiner*—Richard K. Seidel
*Assistant Examiner*—Edward A. Brown
*Attorney, Agent, or Firm*—Samuel M. Learned, Jr.

[57] ABSTRACT

A self-contained heavy duty constant force sliding sash counterbalance assembly embodying a stacked plurality of coil springs each having a uniform coiling and recoiling force throughout all of the various coils irrespective of the individual coil spring positions of extension or contraction, wherein the counterbalance assembly structure is provided with an elongated U-shaped housing adapted to adjustably accommodate the addition or removal of individual spring elements as necessary in order to achieve the proper counterbalance effect for the weight of the particular sash to be supported so that over the raising and lowering range of that sash to which the counterbalance assembly is affixed, and at all adjustably set sash opening elevations and corresponding coil spring positions of extension and contraction therebetween, there is a substantially constantly uniform counterbalance force effect exerted on the sash.

6 Claims, 3 Drawing Sheets

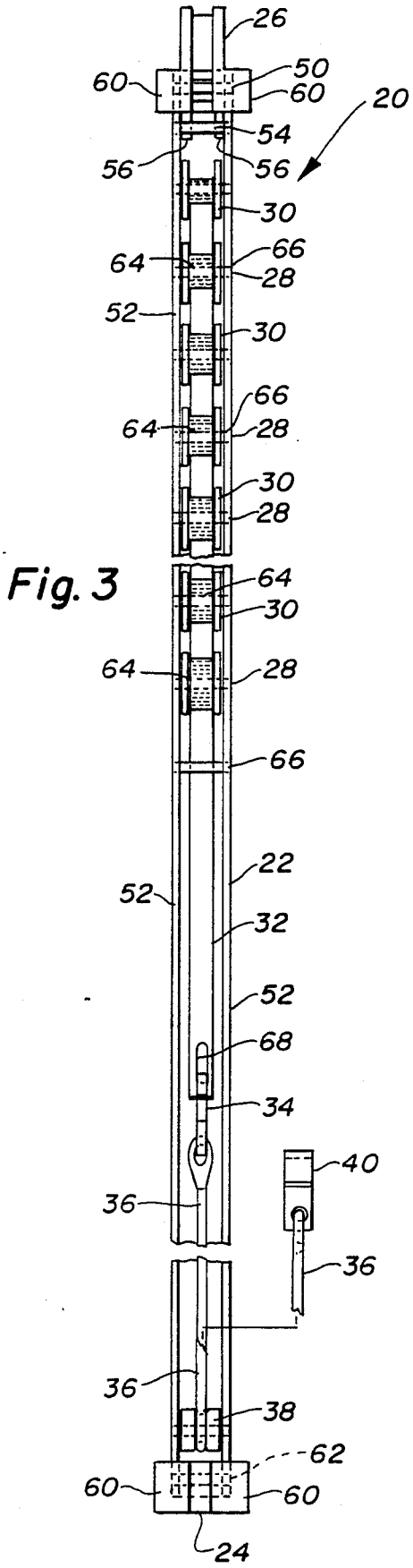
Fig. 3
Fig. 5
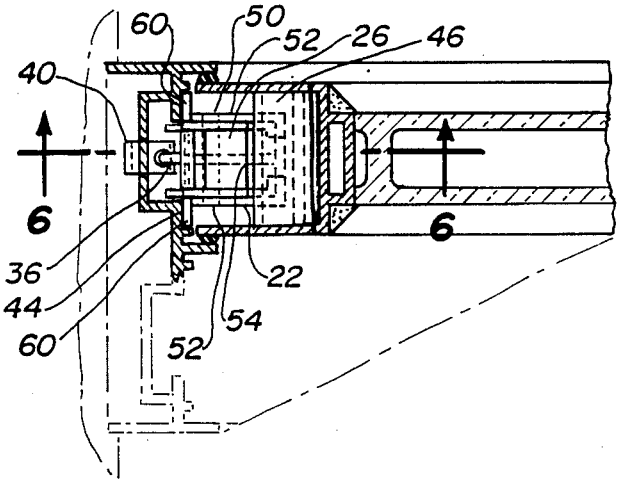
Fig. 6
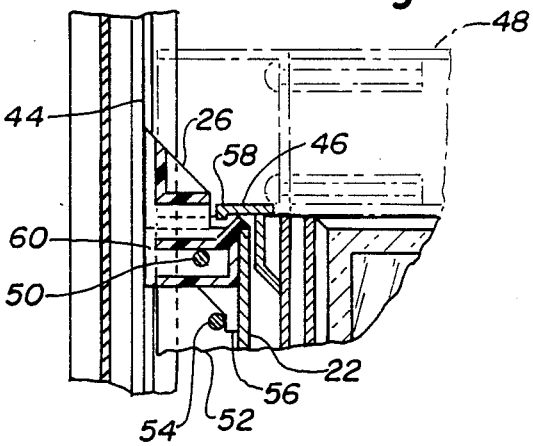
Fig. 7
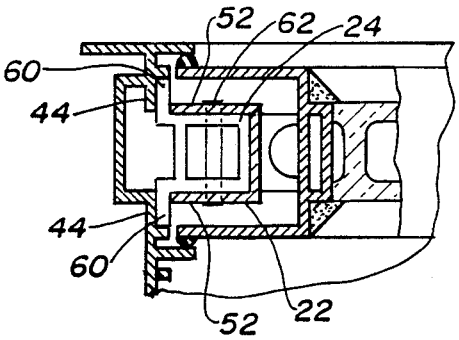

SELF-CONTAINED HEAVY DUTY CONSTANT FORCE SLIDING SASH COUNTERBALANCE ASSEMBLY

BACKGROUND OF THE INVENTION

The present invention relates to a self-contained heavy duty constant force sliding sash counterbalance assembly which embodies as the functional component a stacked plurality of constant force spring elements and is particularly suitable for use as either original equipage or retrofit in counterbalancing the larger and heavier vertically sliding sash construction, and gives the advantageous feature of providing a uniformily constant counterbalancing force over the operational opening range of the sash.

Typical of the spring operational counterbalance assemblies for heavy window sash constructions is that teaching as exemplified in U.S. Pat. No. 3,358,403 to Dinsmore, dated Dec. 19, 1967, which employs the combination of a standard coil spring with a compound pulley arrangement in order to gain a mechanical advantage in accommodating the counterbalance capability to the sash weight. And, in more current versions of the Dinsmore type assembly, a clustered plurality of coil springs may be used to achieve the necessary and desired counterbalance effect. However, although this type of mechanical combination does provide a true offsetting counterbalance capability, it is so functional at only one particular setting of sash opening within the overall range of sash opening possibilities, and at all other sash opening settings it is either substantially in excess of, or less than,that counterbalance force suitably needed.

The use of single constant force coil springs as sash counterbalance means in lighter window constructions is well known, being incorporated as integral components of the overall sash-and-frame construction. Typical exemplary teachings illustrating the foregoing would be as respectively set forth in U.S. Pat. No. 2,609,193 to Foster, dated Sep. 2, 1952, and U.S. Pat. No. 3,475,865 to Arnes, dated Nov. 4, 1969. And, in the case of employment of a constant force coil spring as the sash counterbalance means, a substantially constant counterbalance force is achieved over the opening range of the sash and at all settings therebetween.

The employment of dual constant force coil springs is also taught, which embodiment is primarily for purposes of spring stabilization to prevent rocking and twisting of the extended coil ribbons during use. Exemplary of the dual constant force coil spring sash counterbalance teachings are those as set forth respectively in U.S. Pat. No. 2,635,282 to Trammell, Sr., et al, dated Apr. 21, 1953, and U.S. Pat. No. 3,992,751 to Foster et al, dated Nov. 23, 1976.

The current invention is distinguished over the previous teachings in that it provides a new and novel constant force spring counterbalance assembly of unitized construction, which in turn provides advantages and features as more specifically hereinafter detailed and set forth.

SUMMARY OF THE INVENTION

It is the principal object of the present invention to provide a self-contained heavy duty constant force sliding sash counterbalance assembly of improved unitized construction that may be employed either singly on one side or doubly in combination on both sides of a vertically sliding sash as a sash counterbalance means.

A more specific object of the present invention is to provide a self-contained heavy duty constant force sliding sash counterbalance assembly adapted to be installably utilized within the conventional modern and traditional older sash and jamb structures, as either a retrofit or replacement sash counterbalance means, without the costly need or necessity to re-design or reconstruct either the sash or supporting jamb and frame structures therefor.

Another object of the present invention is to provide a self-contained heavy duty constant force sliding sash counterbalance assembly which employs a stacked plurality of coil springs each having a uniform uncoiling and recoiling force throughout all the various coil irrespective of the radii respectively thereof, which thereby provides a substantially constantly uniform counterbalance force effect throughout the raising and lowering range of the particular sash to which said assembly is affixed, and likewise for all adjustably set sash opening elevations and corresponding coil spring positions of extension and contraction.

It is also an object of the present invention to provide a self-contained heavy duty constant force sliding sash counterbalance assembly that can be used on either or both the upper and lower sashes of either a window or door.

It is a further object of the present invention to provide a self-contained heavy duty constant force sliding sash counterbalance assembly which is adapted to adjustably accommodate the addition or removal of individual spring elements as necessary in order to achieve the proper counterbalance effect for the weight of the particular sash to be supported.

Still another object of the present invention is to provide a self-contained heavy duty constant force sliding sash counterbalance assembly which when operationally installed is hidden from view, and yet is easily accessible for maintenance, repair, or removal as may from time-to-time be necessary.

It is an additional object of the present invention to provide a self-contained heavy duty constant force sliding sash counterbalance assembly which is efficient in design, economical in cost, and easy to install and maintain.

The foregoing, and other objects hereof, will be readily evident upon a study of the following specification and accompanying drawings comprising a part thereof.

BRIEF DESCRIPTION OF THE DRAWINGS

FIG. 3 is a front elevation view of the present invention as viewed from a plane taken along the line 3—3 of FIG. 2, wherein the hook element has been laterally displaced so as to enable a better showing of the cooperative assembly component elements therebehind.

FIG. 5 is a sectional view of the installation assembly detail as seen along the line 5—5 of FIG. 4.

FIG. 6 is a sectional view of the installation assembly detail as seen along the line 6—6 of FIG. 5.

FIG. 7 is a sectional view of the installation assembly detail as seen along the line 7—7 of FIG. 4.

DETAILED DESCRIPTION OF THE INVENTION

Figure 1:
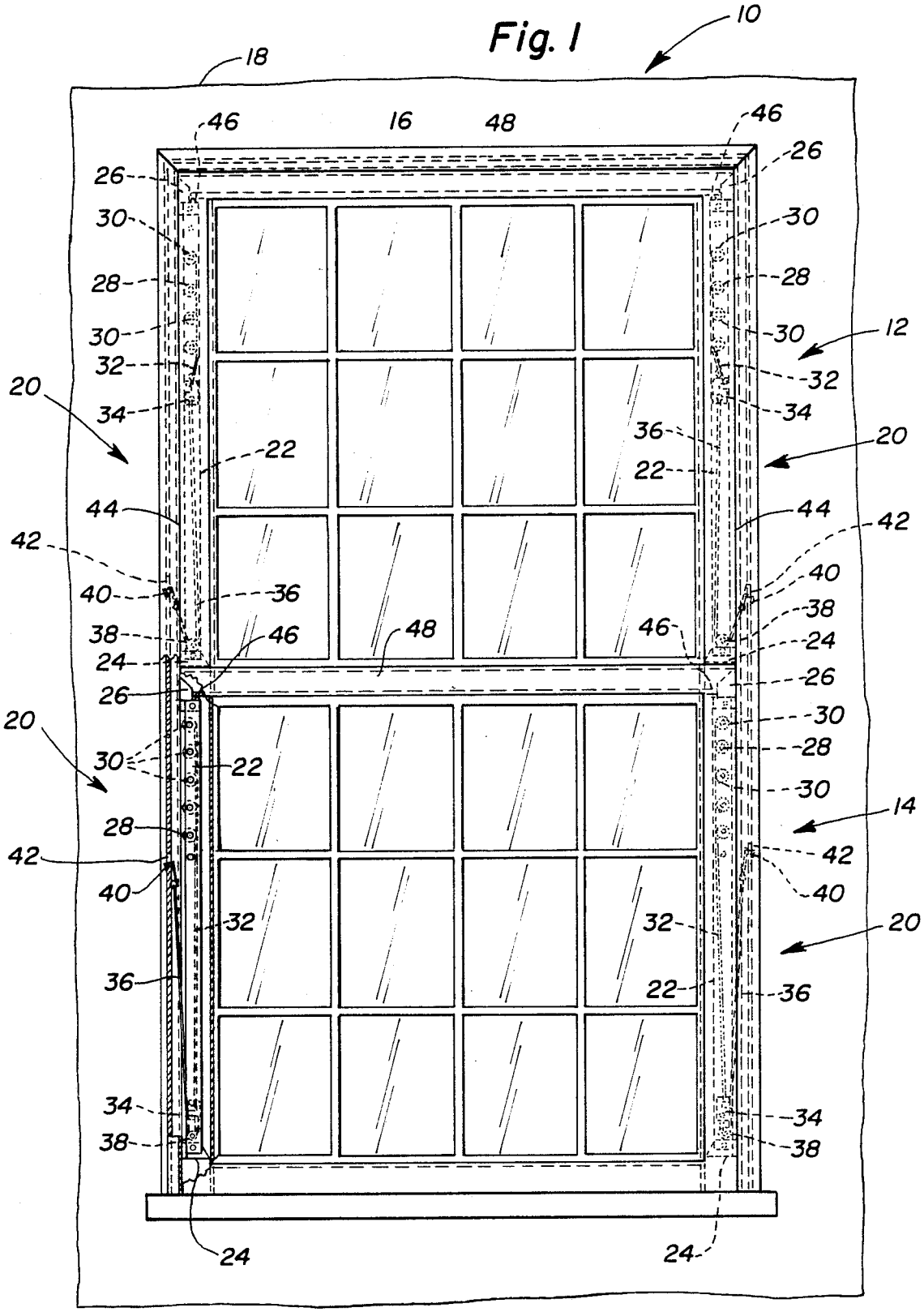
FIG. 1 is a front elevation view of a typical window embodying upper and lower vertically sliding sash members, wherein portions thereof are broken-away to better show the present invention in assembled operable combination therewith.

Referring to FIG. 1, a front elevation view of a typical window 10 embodying an exemplary set of vertically sliding sash members, being an upper sash 12 and a lower sash 14, enclosed within and supported by a typical window frame encasement structure 16 which is in turn installed within and supported by a building wall 18, is shown wherein each of the sash members 12 and 14 are respectively counterbalanced by a spaced set of self-contained heavy duty constant force sliding sash counterbalance 20 devices of instant invention, each shown installed in a manner typical to that as would be exemplary in an original equippage or retrofit application. It should here be noted, however, as would be primarily determined by the size and weight of the sash to be counterbalanced in each particular use application, there may only be a requirement to employ but one of the counterbalance assembly 20 devices to effectively accomplish adequate counterbalance of a sash over the opening range thereof, and although two counterbalance assembly 20 devices are shown in associated use applications with each of the sashes shown in FIG. 1, it is for illustrative and explanatory purposes only and it is to be fully understood that in many use applications only one such counterbalance assembly 20 device would be needed or necessary.

Referring again to FIG. 1 to explain in greater detail more specific aspects of the structure and installation of the self-contained heavy duty constant force sliding sash counterbalance assembly 20 invention hereof. Structurally, the counterbalance assembly 20 device is of unitized construction, that is, it is adapted to be utilized as a single unit of counterbalance hardware and is installed as such. The cooperative mechanical element assemblage of the counterbalance 20 device includes an elongated U-shaped housing 22 which provides a basic support surface for the remainder of the component parts, and in that regard at the one lower end thereof installably supports a foot guide shoe 24 and at the other upper end thereof installably supports a head guide shoe 26. The guide shoes 24 and 26 respectively function as such during vertical movement of either the upper or lower sashes and the counterbalance 20 devices respectively along therewith, as well as also additionally functioning as slidable spacer elements between the sash and window jamb channel respectively corresponding thereto. Between the guide shoes 24 and 26, but generally within the upper half of the elongated U-shaped housing 22, and respectively retained by means of a pintle 28 is a stacked plurality of constant force coil springs 30 which have the coil ribbons 32 thereof respectively withdrawn that length necessary in providing overlapping coincident communication in effecting connection with a retaining catch 34 which in turn connects by means of a hook cable 36 from said retaining catch 34 about a fixed pulley 38 located generally within the lower half of the elongated U-shaped housing 22 to a hook 40. It is the foregoing cooperative structural assembly which comprises the unitized construction of the counterbalance assembly 20 device, and the same will be considered in greater detail on a consideration of the remaining Figures hereinafter.

Installation of the counterbalance assembly is simply accomplished by first connecting the hook 40 thereof retainably within an opening 42 which has been previously prepared in the sash jamb 44, and with the counterbalance assembly 20 device thereafter insertably positioned between the sash 12 or 14 and the jamb 44 with the coil ribbons 32 withdrawn as shown to that extent adjustably necessary such as to thereby effect a continually constant pre-load counterbalance force condition on the sash 12 or 14 over the opening range thereof, a counterbalance retaining stop 46 is then affixed to the end of the upper horizontal sash member 48 to retainably secure said counterbalance assembly 20 device in slidable displacement retention on movement of the sash 12 or 14, with accomplishment of the foregoing, installation of a counterbalance assembly 20 device is thereupon completed unless two such counterbalance 20 devices are to be employed on a single sash 12 or 14, then the same counterbalance assembly 20 device installation procedure would be repeated for the other side of the sash 12 or 14.

The manner of accomplishing a sash 12 or 14 counterbalancing with said counterbalance assembly 20 device is dependent primarily upon the force value of each individual spring 30 and in view thereof determining that number of coil spring 30 multiples which are practically necessary to offset the sash 12 or 14 weight, that is, whether a single counterbalance assembly 20 device of X-number of additive offsetting constant coil spring 30 forces cumulatively applied along one side of the sash 12 or 14 is suitable, or whether for purposes of not only accommodating weight but also physical size of a sash 12 or 14 in terms of operational mechanical balance it would be more suitable to employ two counterbalance assembly 20 devices of ½ X-number of additive offsetting constant coil spring 30 forces applied cumulatively along opposite sides of the sash 12 or 14. Secondly, counterbalancing in terms of coil spring 30 multiples also depends on whether one is working with a lower sash 14 or an upper sash 12, since in the case of a lower sash 14 it is slidably raised to open and lowered to close and in the case of the upper sash 12 it is slidably lowered to open and raised to close, the coil spring 30 combination multiples in order to effect a smooth offsetting constant force counterbalancing of a sash may be further determined by whether that sash is in the lower 14 or upper 12 disposition. In either case, however, both the lower 14 and upper 12 sashes have at all times a constant upward counterbalancing force applied thereto by their respective counterbalance assembly 20 devices.

Operationally, whether the lower sash 14 is being raised or the upper sash 12 is being lowered, in both cases the coil ribbons 32 cooperatively retract and respectively wrap upon themselves in the extending radii form of coil springs 30, thereby continuously compensating automatically to provide a substantially constant counterbalance force over the opening and closing range of the sash 12 or 14. In a reverse operational mode, that is, sash 12 or 14 closing, the coil ribbons 32 extend respectively feeding off the diminishing radii coil springs 30 to provide a reverse counterbalance compensation.

Figure 2:
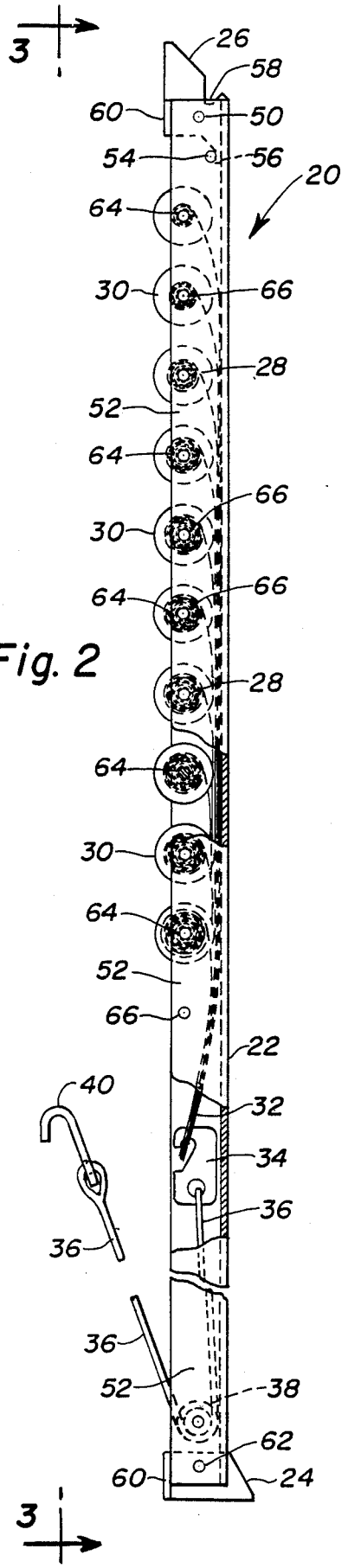
FIG. 2 is an enlarged side elevation view of the self-contained heavy duty constant force sliding sash counterbalance assembly comprising the present invention, wherein portions thereof have been broken-away to better show certain aspects of the internal operational mechanism cooperative assembly component elements.

Considering now concurrently the illustrations shown in FIGS. 2 and 3, being respectively enlarged side and front elevation views of the counterbalance assembly 20 device of instant invention, wherein is shown greater structural assembly detail of the unitized construction thereof, and in particular how the elongated U-shaped housing thereof supports the remaining mechanically cooperative elements thereof.

Starting at the top respectively of FIGS. 2 and 3, it will first be noted that the head guide shoe 26 is retainably assembled supportably upon and within the upper terminal end of the elongated U-shaped housing 22 by means of two pins, being a head guide shoe retaining pin 50 which is compressively inserted through cooperative openings provided both in the elongated U-shaped housing side walls 52 and the head guide shoe 26 as shown, and the second being a compression pin 54 which is retainably inserted through cooperative openings provided in the elongated U-shaped housing side walls 52 only as shown, which pin 54 is disposed to compressively engage a set of head guide shoe depending projections 56 also as shown and thereby in combination with said retaining pin 50 securably retain said head guide shoe 26 in operable position. It will also be noted that the head guide shoe 26 is additionally provided with a counterbalance retaining stop engagement detent 58, and a set of longitudinally projecting sash jamb contact slide pads 60.

Mount ed at the lower terminal end of the elongated U-shaped housing 22 is the foot guide shoe 24, retainably held and supported therewithin by means of the foot guide shoe retaining pin 62, and similar to the head guide shoe 26 the foot guide shoe 24 is likewise provided with a set of sash jamb contact slide pads 60.

In operation, that particular number of constant force springs 30 additively needed in the plurality to accomplish sash counterbalancing is determined by the force value of the springs 30, the weight of the sash to be counterbalanced, and whether one or two spaced counterbalance assembly 20 devices are going to be employed in the particular application at hand.

Based upon an assessment of the foregoing considerations that number of coil springs 30 needed to accomplish near sash weight neutrality is determined and those springs are installed within the elongated U-shaped housing 22 by means of retainable positioning of a pintle 28 respectively through each spring 30 core opening 64 and then insertably installing the pintle 28 ends compressively within the side wall openings 66. It will be noted that additional side wall openings 66 are provided and not all such openings may be utilized in spring 30 installation.

Figure 4:
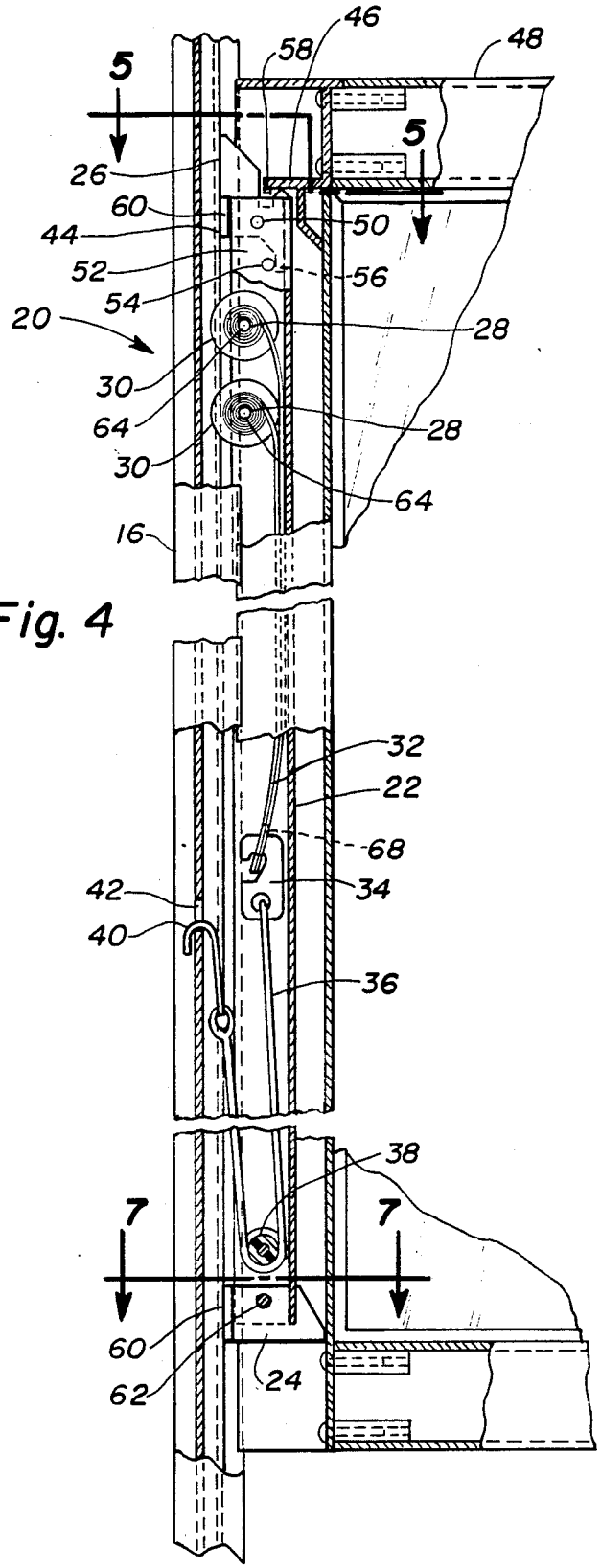
FIG. 4 is an enlarged foreshortened view of the self-contained heavy duty constant force sliding sash counterbalance assembly similar to that as shown in FIG. 2, but herein showing the installation assembly detail thereof in combination with a typical vertically sliding sash and frame structure as shown in FIG. 1.

Once the appropriate number of constant force coil springs 30 are installed as above-described, then the coil ribbons 32 respectively thereof are extended and the catch slots 68 respectively provided therein are sequentially engaged in an over-leafed lapping upon the retaining catch 34 as is shown, wherein the normal position of a spring 30 is that of a tightly wound coil. Thus, it is this plurality of compensating-load type spring 30 coil ribbons 32 which are tensioned to cumulatively wind themselves into a coil, that are mechanically assembled to act as a sash counterbalance by affixing the hook 40 into the opening 42, as more specifically and clearly illustrated on FIG. 4, to thereby substantially provide a nearly uniform upper 12 or lower 14 counterbalancing sash lifting force over the entire opening and closing ranges thereof. In the foregoing regard, and in actual functional operation, the established anchor point 40 remains constant as the sash 12 or 14 is moved and the counterbalance assembly 20 device in a floating relationship therewith, while riding on the upper 26 and lower 24 sash jamb contact slide pads 60 in compressive communication against the counterbalance retaining stop 46, slidably displaces up and down along the sash jamb 44 along with the sash 12 or 14 and thereby effects from the initial neutral counterbalancing coil spring 30 number and set position of coil ribbon 32 extensions, by means of cumulative spring 30 winding and unwinding throughout sash travel, the described compensating counterbalancing result. As previously pointed out, the view shown in FIG. 4 more specifically illustrates the counterbalance assembly 20 device installation in cooperative mechanical association with a typical sash and jamb structure as above-described.

The respective views shown in FIGS. 5 and 6 illustrate greater detail of the head guide shoe 26 and the cooperative assembly thereof with a sash 12 or 14 and the counterbalance retaining stop 46, as well as also the slidable communication contact of the sash jamb contact slide pads 60 thereof with the sash jamb 44.

Lastly, the view shown in FIG. 7 illustrates mechanically cooperative detail of the foot guide shoe 24 structure, and in particular the sash jamb contact slide pads 60 thereof in close slidable support thereof upon the sash jamb 44.

It should again be emphasized, that although structural detail of the self-contained heavy duty constant force sliding sash counterbalance assembly 20 invention hereof is shown and illustrated in what is conceived to be the preferred embodiment thereof, the supporting sash, jamb, and frame structures shown are represented as being typical and are exemplary only and not necessarily restrictive of the only type with which said counterbalance assembly 20 device may be beneficially employed as either original equippage or a retrofit assembly. Accordingly, although the invention has been herein shown and described in what is conceived to be the most practical and preferred embodiment, it is recognized that departures may be made therefrom within the scope of the invention, which is not to be limited to the details disclosed therein but is to be accorded the full scope of the claims so as to embrace any and all equivalent apparatus and devices, and it is to be understood that variations is arrangements and proportions of parts may be made within the scope of the appended claims.

I claim:

1. A self-contained heavy duty constant force sliding sash counterbalance assembly comprising in combination an elongated U-shaped housing having an opposing set of side walls running the entire length thereof, a head guide shoe retainably assembled upon the upper terminal end of said elongated U-shaped housing and a foot guide shoe assembled upon the lower terminal end thereof, a first plurality of complementary side wall openings extending downward from said head guide shoe at regularly spaced intervals centrally intermediate said opposing set of side walls for at least half the length thereof, a second plurality of vertically spaced constant force coil springs each having a coil spring core opening and corresponding in number to at least half that of said first plurality of complementary side wall openings and respectively retainably assembled between said side walls by means of a pintle, a retaining catch to engage a catch slot disposed in a coil ribbon respectively extended from each of said coil springs and by means of such said slot assemble the same upon said retaining catch in an overleafed pile of such said coil ribbons, a hook cable assembled at one end thereof to said retaining catch and dependently therefrom looped around a fixed pulley retainably assembled between said side walls in the lower half of said elongated U-shaped housing but at an elevation above that of said foot guide shoe, and a hook retainably assembled to the free end of said hook cable.

2. The counterbalance assembly according to claim 1 in which said head guide shoe is provided with a set of laterally disposed sash jamb contact slide pads.

3. The counterbalance assembly according to claim 1 in which said foot guide shoe is provided with a set of laterally disposed sash jamb contact slide pads.

4. A self-contained heavy duty constant force sliding sash counterbalance assembly adapted to be cooperatively installed in combination with a sash slidably communicating within a jamb of a typical window frame encasement structure, said counterbalance assembly comprising in combination an elongated U-shaped housing having an opposing set of side walls running the entire length thereof and adapted to be held in close slidable communication between said sash and said jamb by a retaining catch, a head guide shoe retainably assembled upon the upper terminal end of said elongated U-shaped housing and a foot guide shoe assembled upon the lower terminal end thereof, a first plurality of complementary side wall openings extending downward from said head guide shoe at regularly spaced intervals centrally intermediate said opposing set of side walls for at least half the length thereof, a second plurality of vertically spaced constant force coil springs each having a coil spring core opening and corresponding in number to at least half that of said first plurality of complementary side wall openings and respectively retainably assembled between said side walls by means of a pintle, a retaining catch to engage a catch slot disposed in a coil ribbon respectively extended from each of said coil springs and by means of such said slot assemble the same upon said retaining catch in an overleafed pile of such said coil ribbons, a hook cable assembled at one end thereof to said retaining catch and dependently therefrom looped around a fixed pulley retainably assembled between said side walls in the lower half of said elongated U-shaped housing but at an elevation above that of said foot guide shoe, and a hook retainably assembled to the free end of said hook cable and insertably installed within an opening provided in said jamb so that when said sash is raised or lowered said coil springs are thereby caused to wind or unwind in providing a constant force counterbalancing of said sash over the opening and closing range thereof.

5. The counterbalance assembly according to claim 4 in which said head guide shoe is provided with a set of laterally disposed sash jamb contact slide pads.

6. The counterbalance assembly according to claim 4 in which said foot guide shoe is provided with a set of laterally disposed sash jamb contact slide pads.

* * * * *